US006216482B1

(12) United States Patent
Xiao et al.

(10) Patent No.: US 6,216,482 B1
(45) Date of Patent: Apr. 17, 2001

(54) AIR CONDITIONER WITH LOWER NOISE INDOORS

(75) Inventors: Xiao-Song Xiao, Shenzhen; Fu-Qiang Liu, Rm. 101, Bldg. 13, Wenhua Road, Keyuan Garden Science & Industry Park Nan Shan District, Shenzhen Guangdong Province; Sui-Ping He, Unit B, C&F, Tower B, Guangdong International Hotel, 339 Huan Shi Road, Guangzhou City Guangdong Province, all of (CN)

(73) Assignees: Fu-Qiang Liu; Sui-Ping He, both of Guangdong (CN)

( * ) Notice: Subject to any disclaimer, the term of this patent is extended or adjusted under 35 U.S.C. 154(b) by 0 days.

(21) Appl. No.: 09/306,792

(22) Filed: May 7, 1999

(30) Foreign Application Priority Data

May 8, 1998 (CN) ..... 98235716

(51) Int. Cl.[7] ..... F25D 23/12
(52) U.S. Cl. ..... 62/262
(58) Field of Search ..... 62/296, 298, 262

(56) References Cited

U.S. PATENT DOCUMENTS

| | | | | |
|---|---|---|---|---|
| 2,357,362 | * | 9/1944 | Smith | 62/140 |
| 2,660,866 | * | 12/1953 | Tipton et al. | 62/129 |
| 3,815,379 | * | 6/1974 | Scherer et al. | 62/296 |
| 3,898,865 | * | 8/1975 | Stewart et al. | 62/280 |
| 5,203,178 | * | 4/1993 | Shyu | 62/180 |
| 5,313,806 | * | 5/1994 | Feng | 62/295 |
| 5,544,495 | * | 8/1996 | Anderson et al. | 62/457.7 |
| 5,913,892 | * | 6/1999 | Kwon | 62/296 |

* cited by examiner

*Primary Examiner*—William Doerrler
*Assistant Examiner*—Melvin Jones
(74) *Attorney, Agent, or Firm*—Lowe Hauptman Gilman & Berner, LLP

(57) ABSTRACT

An air conditioner with lower noise indoors, characterized in that the indoor unit shell 1 and the outdoor unit shell 2 are connected by connection rods 3 and have a noise deadener 12 therein. In refrigerating system of the air conditioner, by way of totally-enclosed welding, the compressor is connected with its intake pipe and with its discharge pipe, the condenser is connected with the discharge pipe of the compressor and with the capillary tube, the evaporator is connected with its intake pipe, and the intake pipe of the evaporator is connected with the capillary tube.

6 Claims, 3 Drawing Sheets

AIR CONDITIONER WITH LOWER NOISE INDOORS

FIELD OF THE INVENTION

The present invention relates to refrigerating technology, and more particularly to an air conditioner with lower noise indoors.

BACKGROUND OF THE INVENTION

There are two kinds of air conditioners, window air conditioner and split-type air conditioner. A window air conditioner has small size and lower price, but it makes louder noise indoors. Compared with conventional window air conditioner, a split-type air conditioner generates lower noise, but it has its disadvantages as follows: 1. Bulk in volume, high production cost, inconvenient for transportation and installation; 2. The pipes of the indoor unit and outdoor unit are connected by coupler connection, the consequent lack of tightness causes refrigerant leakage, which increases the refrigerant consumption, causes inconvenience for use, and is destructive to ozonosphere; 3. The outdoor fresh air can not be supplied to indoors, which is harmful to human body, and easily to cause "air conditioner symptom"; 4. There is risk for the outdoor unit installed on wall of high buildings to fall down and hurt passengers due to corrosion and looseness of the fixing frame.

SUMMARY OF THE INVENTION

The primary objective of the present invention is to provide an air conditioner with lower noise indoor, which is compact in volume, low production cost, simple and secure in installation, tightness for refrigerant, and can supply fresh air from outdoors to indoors.

In accordance with the present invention, there is provided an air conditioner, comprising refrigerating system, ventilating system, electric controlling system, indoor unit shell and outdoor unit shell, characterized in that, it further comprises at least one connection rods, the indoor unit shell and the outdoor unit shell is connected by said connection rods; in the refrigerating system, by way of totally-enclosed welding, the compressor is connected with its intake pipe and with its discharge pipe, the condenser is connected with the discharge pipe of the compressor and with the capillary tube, the evaporator is connected with its intake pipe, and the intake pipe of the evaporator is connected with the capillary tube.

The air conditioner in accordance with the present invention further comprises a damper corrugated soft pipe. Said intake pipe of the compressor is divided into at least two segments, and the two segments are connected by said damper corrugated soft pipe which is made of materials that can withstand corrosion, high temperature and high pressure. Said intake pipe of the compressor is connected with said damper corrugated soft pipe by way of totally enclosed welding.

The air conditioner in accordance with present invention further comprises noise deadener, which is installed between the indoor unit and the outdoor unit.

Wherein said connection rod is connected in removable mode, and said damper corrugated soft pipe is made of metal.

By implementing the air conditioner according to the present invention, compared with conventional split-type air conditioner, the consumption of raw material can by reduced by 15%, the weight can be reduced by 10%, and the production cost can be reduced by 15–20%. It has advantages of compact in volume, low production and transportation cost, easy and secure for installation. Since the outdoor unit is not fixed on the outside wall, there will be no risk for outdoor unit to fall down and hurt passengers. In addition, by way of totally-enclosed welding, there will be no refrigerant leakage. And thanks to the connection rod, damper corrugated soft pipe, and noise deadener the noise and oscillation caused by the compressor and condenser is blocked outdoors, and the noise indoors is greatly lowered. In addition, outdoors fresh air can be supplied indoors, moving and relocation is as easy as window air conditioner.

Wherein, indoor unit shell is designated as 1, outdoor unit shell as 2, connection rod as 3, compressor as 4, intake pipe of the compressor as 5, discharge pipe of the compressor as 6, condenser as 7, capillary tube as 8, evaporator as 9, intake pipe of the evaporator as 10, damper corrugated soft pipe as 11, noise deadener as 12, cross flow blower as 13 and axial flow fan as 14.

DETAILED DESCRIPTION OF THE PREFERRED EMBODIMENT

Figure 1:
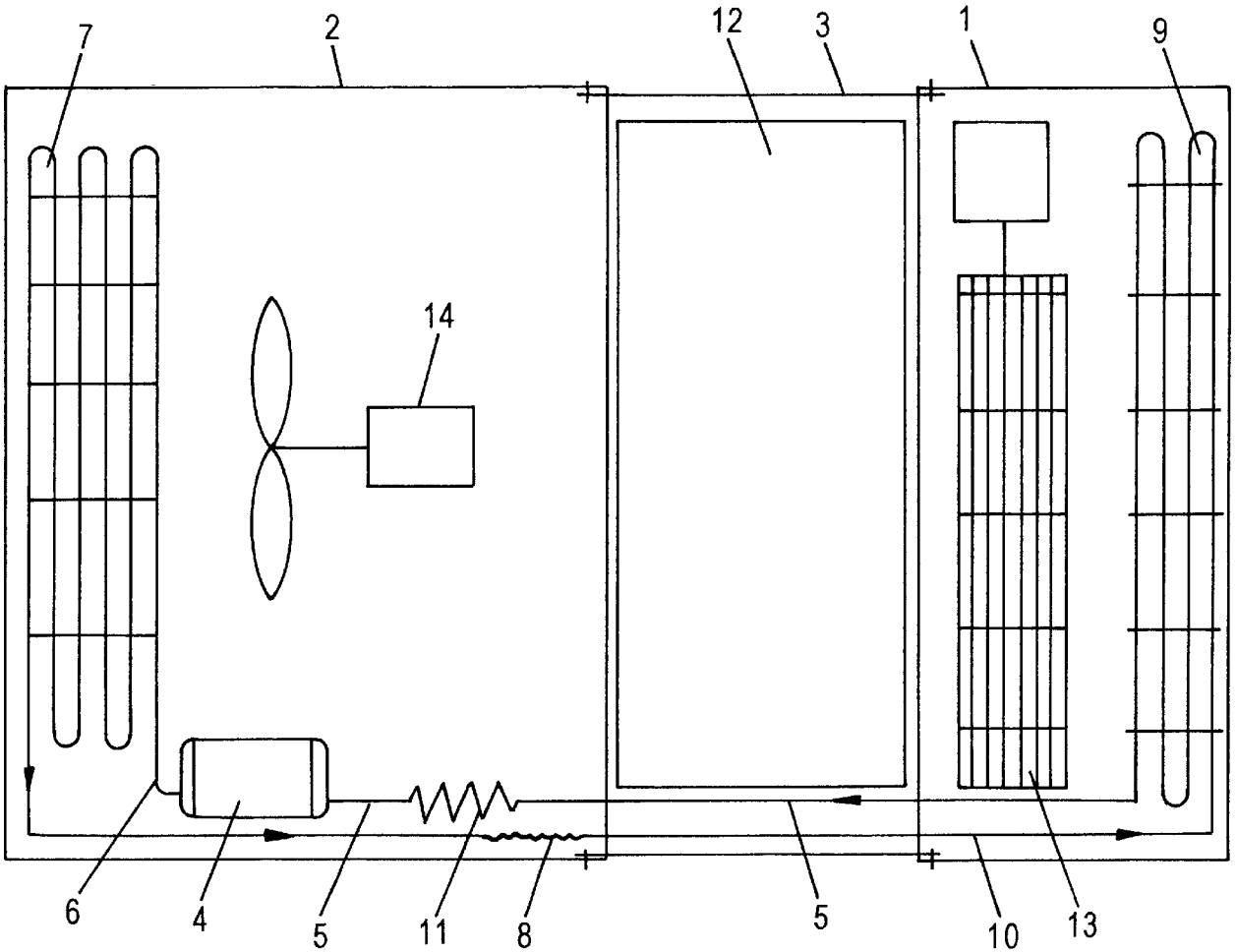
FIG. 1 is the overall schematic diagram of the air conditioner in accordance with the present invention.

Referring to FIG. 1, the air conditioner in accordance with the present invention comprises indoor unit and outdoor unit. The indoor unit includes indoor unit shell 1, and evaporator 9, cross flow blower 13, motor (not shown), etc. which are installed inside the indoor unit shell 1. The outdoor unit includes outdoor unit shell 2, and condenser 7, axial flow fan 14, compressor 4, etc. which are installed inside the outdoor unit shell 2. The outlet of the compressor 4 is connected to the condenser 7 via the discharge pipe 6. The outlet of the condenser 7 is connected with the capillary tube 8, and then enters the inlet of the evaporator 9 via the intake pipe 10. The outlet of the evaporator 9 is connected with inlet of the compressor 4 through the intake pipe 5 and the damper corrugated soft pipe 11, wherein, the intake pipe 5 is divided into two segments (may be divided into multiple segments), and the damper corrugated soft pipe 11 made of materials that can withstand corrosion, high temperature and high pressure is inserted in between. Said damper corrugated soft pipe 11 may be made of metal, while type and material of other parts can be selected according to desire, then the exterior size of the indoor unit shell 1 and the outdoor unit shell 2 is defined. The characterized feature of the air conditioner is that, the compressor 4 is connected with its intake pipe 5 and with its discharge pipe 6, the condenser 7 is connected with the discharge pipe 6 of the compressor 4 and with the capillary tube 8, the evaporator 9 is connected with its intake pipe 10, the intake pipe 10 of the evaporator 9 is connected with the capillary tube 8, and the intake pipe 5 of the compressor 4 is connected with the damper corrugated soft pipe 11, all by way of totally-enclosed welding.

Figure 2:
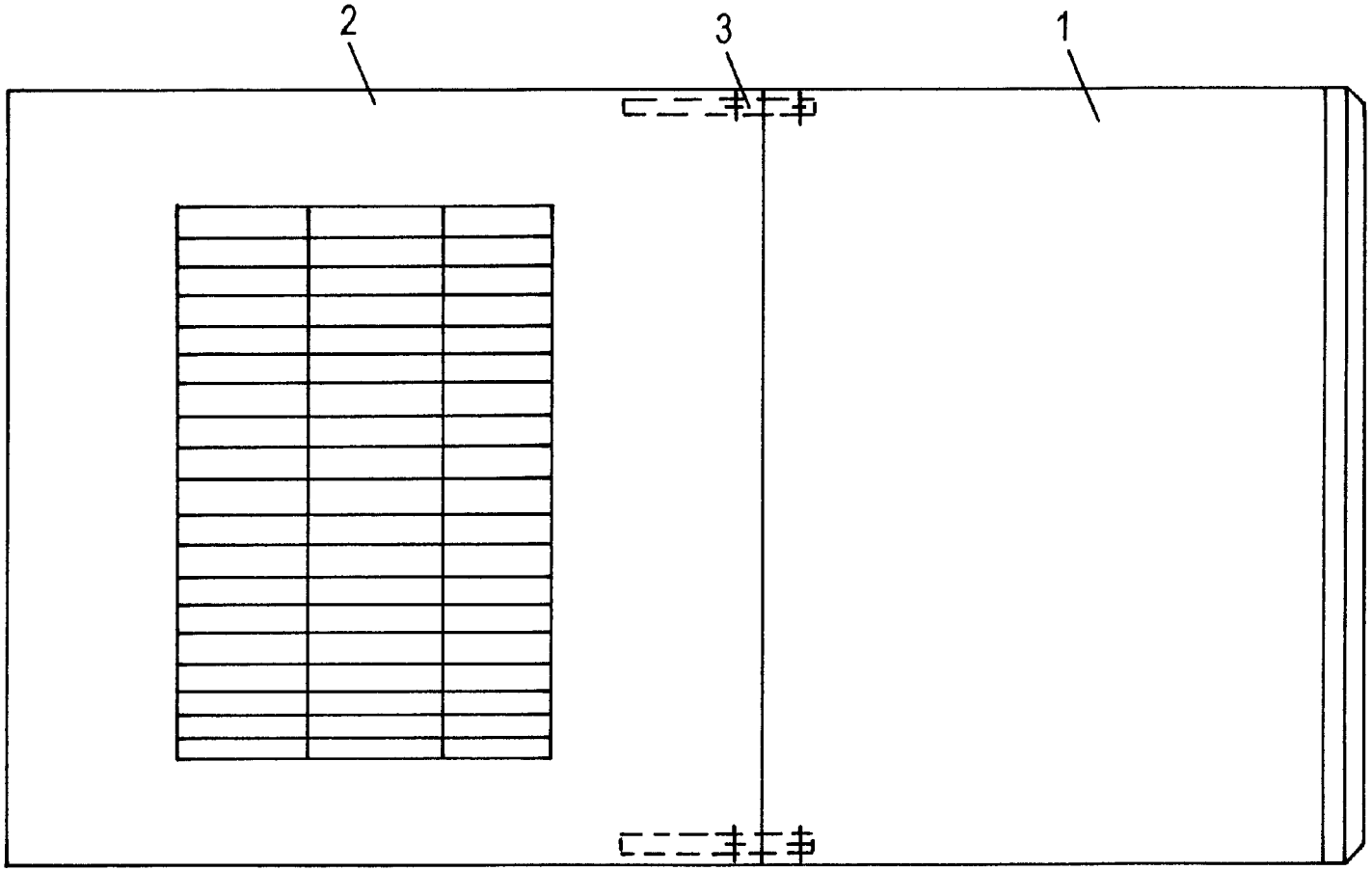
FIG. 2 is the schematic diagram showing the indoor unit and the outdoor unit of the air conditioner combined together.

Referring to FIG. 1, the indoor unit shell 1 and the outdoor unit shell 2 are connected by four connection rods 3. Said connection rods 3 are made of metal, for example, may be 40 mm in length. The function of the connection rods is to attach the indoor unit to the outdoor unit. The connection rods may be removably connected or fixed connected with the indoor unit and the outdoor unit. Between the indoor unit and the outdoor unit, there is installed a noise deadener 12 to block the noise generated by the compressor 4 and axial flow fan 14 from the outdoor unit to indoor. Said noise deadener 12 may be made of foam material or other acoustic insulation materials. Taking away the connection rods 3 and the noise deadener 12, the indoor unit and the outdoor unit can be combined together, as shown in FIG. 2.

Figure 3:
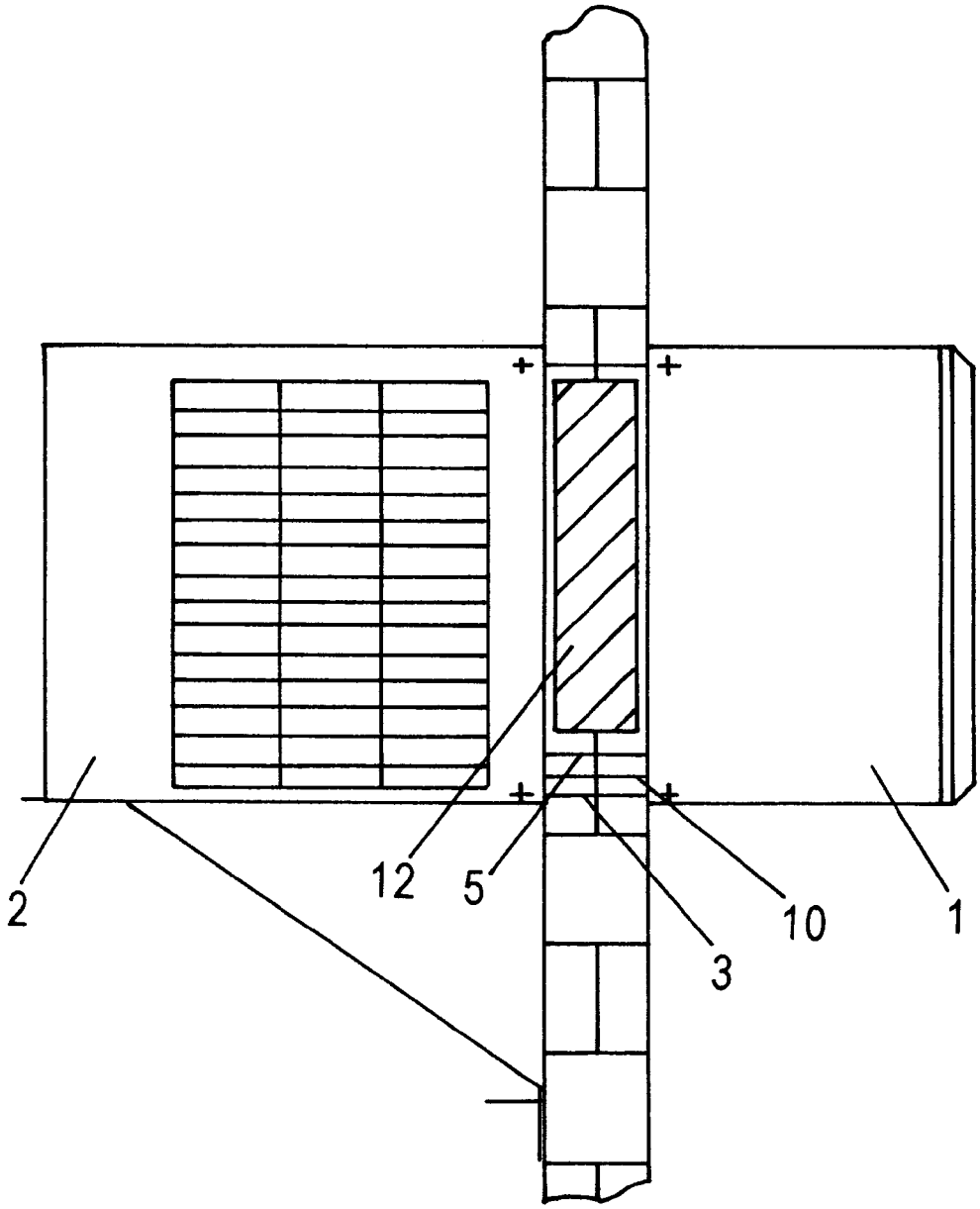
FIG. 3 is the installation diagram of the air conditioner in accordance with the present invention.

The installation of the air conditioner in accordance with present invention is shown as FIG. 3. Referring to FIG. 3, the indoor unit shell 1 and the outdoor unit shell 2 is installed respectively on two sides of the wall. In between the two units, there are connection rods 3, intake pipe 10 of the evaporator 9, intake pipe 5 of the compressor 4 and the noise deadener 12. The present invention is realized by connecting the indoor unit and the outdoor unit of the conventional split-type air conditioner with connection rods and noise deadener inserted, then welding and installing as described above with reference to FIG. 1. Experiments show that, the noise of the indoor unit of the air conditioner in accordance with the present invention is no more than (≦) 40 dB.

What is claimed is:

1. An air conditioner, comprising a refrigerating system, a re-circulating air stream system, an indoor unit shell and an outdoor unit shell, and at least one connection rod for connecting the indoor unit shell and the outdoor unit shell; the refrigerating system including a compressor, a condenser, a capillary tube and an evaporator, wherein by way of welding, the compressor is connected with a compressor intake pipe and with a compressor discharge pipe, the condenser is connected with the discharge pipe of the compressor and with the capillary tube, the evaporator is connected with an evaporator intake pipe, and the intake pipe of the evaporator is connected with the capillary tube.

2. An air conditioner as defined in claim 1, characterized in that, the air conditioner further comprises a damper corrugated soft pipe, which is made of materials that can withstand corrosion, high temperature and high pressure, which is connected with the said intake pipe of the compressor by way of totally-enclosed welding.

3. An air conditioner as defined in claim 2, characterized in that, said intake pipe of the compressor is divided into at least two segments connected by said damper corrugated soft pipe.

4. An air conditioner as defined in claims 2, characterized in that, said damper corrugated soft pipe is made of metal.

5. An air conditioner as defined in claim 1, characterized in that, the air conditioner further comprises noise deadener, which is installed between the indoor unit and the outdoor unit.

6. An air conditioner as defined in claims 1, characterized in that, said connection rod is connected in removable mode.

* * * * *